US005207803A

United States Patent [19]

Holsten et al.

[11] Patent Number: 5,207,803

[45] Date of Patent: May 4, 1993

[54] METHOD FOR DYEING AROMATIC POLYAMIDE FIBROUS MATERIALS: N,N-DIETHYL(META-TOLUAMIDE) DYE CARRIER

[75] Inventors: John R. Holsten, Spartanburg; Nigel E. Neely, Rock Hill, both of S.C.

[73] Assignee: Springs Industries, Fort Mill, S.C.

[21] Appl. No.: 589,919

[22] Filed: Sep. 28, 1990

[51] Int. Cl.[5] ..... D06P 1/64; D06P 1/649; D06P 3/24; D06P 3/26

[52] U.S. Cl. ..... 8/586; 8/490; 8/529; 8/531; 8/654; 8/657; 8/925

[58] Field of Search ..... 8/490, 586, 654

[56] References Cited

U.S. PATENT DOCUMENTS

| | | | |
|---|---|---|---|
| 2,895,948 | 7/1959 | Brinker et al. | 260/78.4 |
| 3,558,267 | 8/1967 | Langford | 8/586 |
| 3,616,473 | 11/1971 | Leach | 8/586 |
| 3,634,023 | 1/1972 | Foote | 8/130.1 |
| 3,741,719 | 6/1973 | Ramanathan et al. | 8/654 |
| 3,789,091 | 1/1974 | Anderson et al. | 260/927 |
| 3,918,901 | 11/1975 | Ida et al. | 8/535 |
| 3,953,168 | 4/1976 | Fabbri | 8/477 |
| 4,073,615 | 2/1978 | Lacroix et al. | 8/527 |
| 4,397,759 | 8/1983 | Hancock | 252/609 |
| 4,705,523 | 11/1987 | Hussamy | 8/490 |
| 4,710,200 | 12/1987 | Cates et al. | 8/574 |
| 4,752,300 | 6/1988 | Johnson | 8/584 |
| 4,758,649 | 7/1988 | Asano | 528/73 |
| 4,780,105 | 10/1988 | White | 8/574 |
| 4,898,596 | 2/1990 | Riggins et al. | 8/490 |

FOREIGN PATENT DOCUMENTS

| | | |
|---|---|---|
| 57-167464 | 10/1982 | Japan . |
| 1275459 | 5/1972 | United Kingdom . |
| 1282113 | 7/1972 | United Kingdom . |

OTHER PUBLICATIONS

Evaluation of the STX System for Solvent Dyeing of Industrial Fabrics Part II:, Fred L. Cook and Madeline L. Averette.

Aramid Fibers, Kirk-Othmer: The Encyclopedia of Chemical Technology Third Edition, vol. 3, pp. 213-242.

Chemical Abstracts, vol. 98, No. 14, Apr. 4, 1983, Abstract No. 108808.

*Primary Examiner*—A. Lionel Clingman

*Attorney, Agent, or Firm*—Bell, Seltzer, Park & Gibson

[57] ABSTRACT

A method for dyeing fibrous material is provided. The method includes contacting a fibrous material with a carrier and a dye soluble or dispersed with the carrier in a dyebath. The carrier comprises an N-substituted aromatic carbonamide or an N,N-disubstituted aromatic carbonamide or mixture thereof. The carrier system of the present can be advantageously utilized for improving dye and flame resistant properties of difficult to dye fibers such as aromatic polyamide fibers, polybenzimidazole fibers and aromatic polyimide fibers.

39 Claims, No Drawings

METHOD FOR DYEING AROMATIC POLYAMIDE FIBROUS MATERIALS: N,N-DIETHYL(META-TOLUAMIDE) DYE CARRIER

The present invention relates to a method for dyeing fibrous material, and particularly fibrous materials having flame resistant properties which are difficult to dye such as aromatic polyamides, polybenzimidazoles or aromatic polyimides.

BACKGROUND OF THE INVENTION

There are various recognized methods for dyeing and/or incorporating additives into fibers and other fibrous materials, including methods which utilize organic solvents such as dimethylsulfoxide ("DMSO"), dimethylacetamide ("DMAc"), dimethylformamide ("DMF"), N-methylpyrrolidone ("NMP"), N-cyclohexyl-2-pyrrolidone ("CHP"), acetophenone, acetanilide and methyl benzoate. Exemplary systems utilizing these organic solvents have been proposed in U.S. Pat. Nos. 3,558,267 to Langenfeld, 3,741,719 to Ramanathan et al, 4,525,168 to Kelly, and U.S. Pat. No. 4,898,596 to Riggins et al and U.K. Patent Nos. 1,275,459 to Gruen and 1,282,113 to Burtonshaw et al. In addition to these organic solvents it has been proposed in U.S. Pat. No. 4,780,105 to White et al to dye aromatic polyamides with a cationic dye and a dye assistant including N-substituted phthalimides (e.g., a mixture of N-butylphthalimide and isopropylphthalimide).

Despite the general availability of dyeing methods using various carriers, there continues to be a desire for process improvements which enhance the dyeability of fibers and fabrics formed therefrom. For example, improvements in dye exhaustion and more uniform dyeing tend to improve the aesthetic characteristics of the fibers. Another example is that certain dyeing techniques result in the undesirable side effect of retention of solvent by the fibers. Retention of solvent can adversely affect both the appearance and the flame resistance of the fibers. This is particularly frustrating when dyeing fibers such as the aromatic polyamides, i.e., poly(m-phenyleneisophthalamide) ("Nomex®") and poly(p-phenyleneterephthalamide) ("Kevlar®"), polybenzimidazoles, aromatic polyimides, and the like which have excellent flame resistant properties but also are difficult to dye. In order to dye these fibers, some of the various organic solvents and carriers, e.g., DMAc, DMSO, DMF, acetophenone, etc., and the N-substituted phthalimides have to be used, but these compounds may present health problems for some employees, and if non-water soluble, also tend to be retained by the fibers after dyeing. Thus, prior art techniques for dyeing these fibers can be counter-productive in that one of the problems caused by retention of solvent or carrier, e.g., decreased flame resistance, requires addition of a significantly large portion of a flame retardant to compensate for the reduction in the flame resistant properties of the fibers.

It is therefore an object of the present invention to provide an improved method for dyeing fibrous materials, and particularly to provide a method which provides one or more particularly advantageous results, including increased efficiency in dye exhaustion, more uniform dyeing and reduction of the retention of solvent. The improved method is particularly advantageous when used with difficult to dye fibers such as aromatic polyamide fibers including Nomex® and Kevlar® fibers, polybenzimidazole fibers, aromatic polyimide fibers, fibers of copolymers of the monomers thereof and blends thereof.

SUMMARY OF THE INVENTION

This invention relates to a method for dyeing fibrous material which includes the steps of contacting the fibrous material with a mixture (e.g., a solution or dispersion) containing a dye in a dye carrier (e.g., a dyebath) comprising an N-substituted aromatic carbonamide or an N,N-disubstituted aromatic carbonamide or mixture thereof and fixing the dye in the fibrous material. The use of the present carrier results in improved dyeing characteristics. For example, improved efficiency in dye exhaustion may be achieved as compared to comparable levels of other carriers particularly when used to dye fibers such as aromatic polyamide fibers, polybenzimidazole fibers, aromatic polyimide fibers, fibers of copolymers of the monomers thereof and blends thereof.

In accordance with a particularly preferred embodiment of the present invention, the method of the present invention includes the steps of contacting aromatic polyamide fibers, polybenzimidazole fibers, aromatic polyimides fibers, fibers of copolymers of the monomers thereof, or blends thereof with a mixture of a carrier and dye soluble or dispersed with the carrier, the carrier including an N-substituted aromatic carbonamide or an N,N-disubstituted aromatic carbonamide or mixture thereof, an emulsifier and a flame retardant, and fixing the dye in the fibers. The emulsifier provides improved dyeing characteristics (e.g., improved dye exhaustion and more uniform dyeing) whereas the use of the flame retardant in small amounts (e.g. less than about 2 g/100 ml) results in "super flame resistant" properties in the fibers, i.e., less than 25 percent of the fabric formed from the fibers is consumed using Federal Test Method 191-5905 Flame Contact Test).

DETAILED DESCRIPTION OF THE INVENTION

As summarized above, the present invention provides an improved carrier system and carrier-based method for dyeing and/or incorporating other additives into fibrous materials. The carrier and method is particularly adapted for use in reducing the adverse effect of dyeing methods on dye exhaustion, dye uniformity and flame resistant properties of the fibrous material. The carrier preferably comprises an N-substituted aromatic carbonamide or an N,N-disubstituted aromatic carbonamide or mixture thereof. In a preferred embodiment, the carrier system can include an emulsifier and/or a flame retardant.

The method of the present invention can advantageously be employed using customary dyeing techniques. The dye and the carrier, and the addition of the emulsifier, flame retardant, and/or other additives is typically carried out by forming a mixture (e.g., a bath, solution, dispersion or the like) of the dye and the carrier of the present invention followed by contacting the fiber and/or fabric with this mixture and then fixing the dye in the fiber. In accordance with the present invention, a fibrous textile material, e.g., fiber, web, yarn, thread, sliver, woven fabric, knitted fabric, non-woven fabric, and the like is impregnated, padded, or otherwise contacted with the bath and the dyestuffs and/or additives fixed in the substrate using conventional equipment such as jet dyeing or other appropriate equipment.

The carrier of the present invention comprises an N-substituted aromatic carbonamide or an N,N-disubstituted aromatic carbonamide or mixture thereof. Generally these compounds can be represented by the formula:

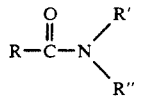

wherein R is aromatic or substituted aromatic, R′ is H or alkyl and R″ is alkyl, aromatic, substituted aromatic or aralkyl. Exemplary compounds include:

Benzanilide

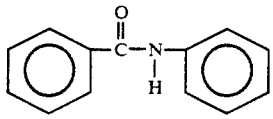

N,N-dimethylbenzamide

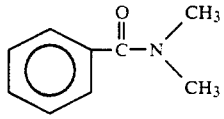

N,N-diethyl(m-toluamide)

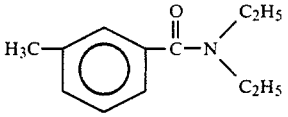

N-substituted and N,N-disubstituted aromatic carbonamides have previously been utilized as surface plasticizers for nylon such as described in U.S. Pat. No. 3,634,023 to Foote, herein incorporated by reference. However, applicants are unaware of the use of N-substituted or N,N-disubstituted aromatic carbonamides as a carrier in dyeing fibers.

A particularly preferred N,N-disubstituted aromatic carbonamide is N,N-diethyl(m-toluamide), "DEET". DEET is a liquid at room temperature and is used predominantly as an insect repellant and a resin solvent in addition to being used as a surface plasticizer. Preferably, the carrier system also includes a compound which permits the dye and the carrier and other additives to be held in suspension or dispersion, i.e., an emulsifier. Additionally, the compound can function as a dye assist or levelling agent.

A particularly preferred emulsifier is Phosphoteric T-C6®, an amphoteric surfactant, available from Mona Industries, Inc. of Patterson, N.J. Another particularly preferred emulsifier is Solv-It®, a multicomponent system containing a blend of surfactants and an alkyl ester of an aromatic carboxylic acid available from Apollo Chemical Company of Burlington, N.C.

Another particularly preferred emulsifier is Witcomul®AM2-10C available from Witco Chemical of New York, N.Y. Witcomul® AM2-10C is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide. Other compounds suitable for use with the carrier as a dye assist are diphenyl, 1-methylnaphthalene, 2-methylnaphthalene, alkyl and aryl benzoates, chlorotoluenes, and the like.

Preferably, a flame retardant can also either be included with the carrier in the dyebath, applied as an after-dyeing surface treatment or otherwise incorporated in the fiber to provide super flame resistant properties. A particularly preferred flame retardant is Antiblaze® 100 flame retardant, a non-cylic chloroalkyl diphosphate ester, available from Albright & Wilson Americas, Inc. of Richmond, Va.

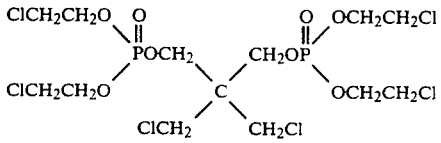

Other flame retardants suitable for use are other non-cylic mono- and poly- phosphonate and/or phosphate-type flame retardants available from Albright & Wilson Americas, Inc. In addition, another class of suitable flame retardants are those based on primary guanidine phosphates.

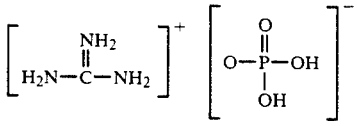

Preferably, the ratio of N-substituted or N,N-disubstituted aromatic carbonamide to emulsifier to flame retardant can be from about 2:3:0.1 to about 8:1:0.5, preferably about 2:3:0.3 to about 3:2:0.3, and more preferably about 4:1:0.3 if Solv-It®or Phosphoteric T-C6® is used, and about 2:0.1:0.1 to about 8:1:1.5, preferably about 4:0.1:0.1 to 3:0.3:0.5, and more preferably about 4:0.2:0.4 if Witcomul® AM2-10C is used. The total weight of the carrier in the dyebath will be in the range from about 1 to about 3 percent based on the weight of the dyebath. The weight percent can be adjusted using water or any other liquid miscible or dispersible with the carrier.

In view of the desirable results achieved to date, it is thought that the use of the carrier of the present invention is applicable with a wide variety of other additives such as softeners, UV absorbers, IR absorbers, antistatic agents, antifoaming agents, bactericides, fungicides, anti-viral agents or the like, and to a wide variety of fibrous material and includes dyed fibers which have been formed into fabrics including woven, non-woven or knit fabrics, for example.

The carrier can be used advantageously to dye a variety of flame resistant fibers which are difficult to dye, namely, aromatic polyamides, polybenzimidazoles, and aromatic polyimides, copolymers of the monomers thereof, and blends thereof. As noted above the carrier is particularly desirable for use with aromatic polyamides. Fibers of aromatic polyamides have flame resistant properties and are often generically termed "aramid fibers" and are described, for example, in *Kirk-Othmer: The Encyclopedia of Chemical Technology*, Third Edition, Vol. 3, pp. 213–242, the disclosure of which is incorporated herein by reference. The term "aromatic polyamides" or "aramids" includes but is not limited to poly(m-phenyleneisophthalamide) (e.g., Nomex®), poly(p-phenyleneterephthalamide) (e.g., Kevlar®), polyparabenzamide, copolymers of the monomers thereof, and blends therewith. Nomex® is available from DuPont of Wilmington, Del., in three forms. Nomex® T-450 is 100 percent, undyed poly(m-phenyleneisophthalamide); Nomex® T-456 is 100 percent solution dyed poly(m-phenyleneisophthalamide); and Nomex® T-455 is a blend of 95 percent Nomex® (poly(m-phenyleneisophthalamide)) and 5 percent Kevlar® (poly(p-phenyleneterephthalamide)). Nomex® T-455 with the 5 percent Kevlar® fraction is the most common type of Nomex® used commercially. In view of the ability to dye the Kevlar® fraction of Nomex® T-455 more uniformly at a temperature above about 250° F., it is believed that the carrier of the present invention can be used at temperatures above about 250° F. to dye blends of other fibers with Kevlar® in a more uniform manner.

Another group of fibers which have flame resistant properties and are difficult to dye are the polybenzimidazole fibers available from Höechst-Celanese of Charlotte, N.C. and are described in U.S. Pat. No. 2,895,948 to Brinker et al, the disclosure of which is incorporated herein by reference. Polybenzimidazoles use specific dicarboxylic and tetramine compounds as monomers and have the repeating unit of the formula:

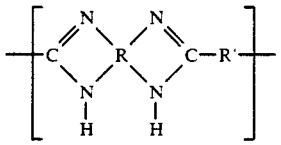

where R and R' are aromatic moieties.

Another group of fibers having flame resistant properties and are difficult to dye are aromatic polyimide fibers described in U.S. Pat. No. 4,758,649 to Asano et al, the disclosure of which is incorporated herein by reference. The aromatic polyimides have the repeating unit of the formula:

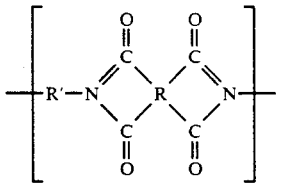

where R and R' are aromatic moieties.

In addition, copolymers of monomers or blends of the aromatic polyamides, polybenzimidazoles and/or aromatic polyimides can advantageously be dyed using the present carrier. For example, aromatic polyamide fibers and polybenzimidazole fibers can be blended in a weight ratio of about 60:40 to about 80:20 aromatic polyamide fibers to polybenzimidazole fibers. The blends can be in the form of intimate blends, draw blends, corespun and the like. Additionally other synthetic fibers such as acrylic, modacrylic, polyesters and aliphatic polyamides can be advantageously dyed using the carrier system of the present invention.

Dyes which can be used advantageously with the present carrier can include acid dyes (e.g., azo, triarylmethane, anthraquinone dyes etc.); basic dyes (e.g., triphenylmethane, thiazide dyes, etc.); direct dyes (e.g. sulphonated azo dyes etc.); mordant dyes; vat dyes; disperse dyes (e.g., nitroarylamine, azo, or anthraquinone dyes and the like with amino groups); reactive dyes; and mixtures thereof with the proviso that the dyes do not decompose under customary dyeing conditions. Particularly effective dyes for dyeing aromatic polyamide fibers, polybenzimidazole fibers and aromatic polyimide fibers are the basic dyes (sometimes referred to as "cationic dyes"). Examples of this class are the Basacryl® dyes available from BASF, Charlotte, N.C. and the Maxillon® dyes available from Ciba-Geigy Corporation, Greensboro, N.C.

In operation, the dye and/or other additive is preferably applied to the fibers of a fabric using a one-step batch-type process at 100° F. to 300° F. at 1 to 4 atm pressure. Pre-scouring and after-scouring of the fabric is preferred. The fabric can be scoured by passing the fabric through a hot aqueous scour in a jet dye machine or other scouring equipment. The jet is then charged with water and other auxiliaries including the dye and the present carrier with or without an emulsifier and with or without a flame retardant or other additive. The temperature and pressure are then increased to a temperature above about 250° F. and preferably about 270° F. and a pressure above about 2.5 atm and held for about 30 minutes to about 1.5 hours while the jet is working. The fabric is allowed to cool, the dyebath dropped, the fabric rinsed and then an after-scour is performed using a wetting agent and soda ash in the jet. The resulting fabric has greater than 90 percent of the charged dyestuff, preferably about 98 percent exhausted into the fabric. The dye, flame retardant and/or additive is fixed into the fiber during the dye cycle.

Additional benefits and advantages of the invention will be apparent from the following illustrative

EXAMPLE 1

Using Nomex® T-455 (95% Nomex® and 5% Kevlar®) fibers and a jet dye apparatus, the jet is loaded at a 10:1 liquor-to-goods ratio with fresh water, 2.0% owf soda ash and 2.0% owf wetting agent, and the temperature of the fabric formed from the fibers raised to 160.F. The jet is run at 160° F. for 30 minutes. The bath is then dropped and the fabric is rinsed clear using cold water.

A dye run is performed using a 10:1 liquor-to-goods ratio with a dyebath including 2 g/100 ml of dyebath of N,N-diethyl(m-toluamide) (referred to hereinafter in the examples as "DEET") as a carrier. The bath is set below about 120° F. and run for 10 minutes. A navy blue cationic dye formulation containing 11.25% owf ("on weight of fabric") 100% Basacryl Blue X-3GL, 1.41% owf Basacryl Red GL and 0.90% owf 200% Basacryl Golden Yellow X-GFL is added and run in the jet for 10 minutes. 2 g/100 ml of dyebath of sodium nitrate is added over a 10 minute period followed by 2% owf formic acid. The temperature is raised to 270° F. at a rate of 3° F./minute. The fabric is then dyed for an extended period of 60 minutes at an elevated temperature of about 270° F. and at a pressure of about 2.85 atm. The dyed fabric is cooled to 160° F. and the shade checked. When the shade is acceptable, the dyebath is dropped and the fabric is rinsed clean in cold water.

An after-scour is done at a 10:1 liquor-to-goods ratio in a bath comprising about 2% owf of wetting agent and about 2% owf of soda ash. The temperature is raised to 160° F. and the fibers of the fabric scoured for 30 minutes at 160° F. The scouring bath is dropped and the fabric rinsed until the rinse is clear. The fabric is then dried.

The depth of shade of the fabrics are determined subjectively by sight, and objectively using the L*, a*, b* scale. The latter uses a colorimeter available from HunterLab of Fairfax, Va. set at 10. illumination and having a D65 light source. The L*, a*, b* scale is based on the opponent-colors theory of color vision which presumes that in the human eye there is an intermediate signal-switching stage between the light receptors in the retina and the optic nerve taking color signals to the brain. In this switching stage, red responses are compared with green to generate a red-to-green color dimension. The green (or red and green together, depending on theory used) response is compared in a similar manner with the blue to generate a yellow-to-blue color dimension. These two dimensions are often, though not always, associated with the symbols "a*" and "b*", respectively. The necessary third dimension, "L*", for lightness, is usually a non-linear function such as the square root or cube root of one of the dimensions. The resulting fabric of Example 1 had a deep shade of blue, and an L* value of 20.27, an a* value of −0.19 and a b* value of −6.99. The values obtained for L*, a*, b* depth of shade compare satisfactorily to those obtained with other carriers such as CHP and substituted N-phthalimides.

EXAMPLE 2

In order to demonstrate the effectiveness of an N-substituted carbonamide instead of an N,N-disubstituted aromatic carbonamide, the steps of Example 1 are repeated except 1.5 g/100 ml of dyebath of benzanilide is used as the carrier. The resulting fabric had a deep shade of blue and an L* value of 19.77, an a* value of −0.14 and a b* value of −6 09.

EXAMPLE 3

In order to demonstrate the effectiveness of a different N,N-disubstituted aromatic carbonamide, the steps of Example 1 are repeated except N,N-dimethylbenzamide is used as the carrier. The resulting fabric had a deep shade of blue and an L* value of 19.31, an a* value of 1.03 and a b* value of -9.32.

The results of Examples 1-3 indicate that the use of the various N-substituted and N,N-disubstituted aromatic carbonamides as carriers provide excellent depth of shade properties when added to the dye baths.

EXAMPLE 4

In order to demonstrate the effectiveness of the inclusion of an emulsifier, the steps of Example 1 are repeated except 0.2 g/100 ml of dyebath of an amphoteric surfactant (Phosphoteric T-C6 ®) emulsifier is included in the carrier system. The resulting fabric had a deep shade of blue, and an L* of 18.57, an a* value of 0.44 and a b* value of −6.19.

EXAMPLE 5

In order to demonstrate the effectiveness of the inclusion of a different emulsifier, the steps of Example 1 are repeated except 0.5 g/100 ml of dyebath of Solv-It ® is included in the carrier. The resulting fabric had a deep shade of blue, and an L* value of 18.81, an a* value of 0.05 and a b* value of −5.96.

EXAMPLE 6

In order to demonstrate the effectiveness of the present carrier when a flame retardant is included with the carrier, the steps of Example 1 are repeated except the carrier system includes 0.92 g/100 ml of dyebath of Antiblaze ® 100 flame retardant. The resulting fabric had a deep shade of blue, and a L* value of 17.35 an a* value of 0.95 and a b* value of −6.71. This indicates that improved dye characteristics results when a flame retardant is included in the carrier. When the steps of Example 1 are repeated using 2.0 g/100 ml of dyebath of CHP and 0.9 g/100 ml of dyebath of Antiblaze ® 100 as the carrier system, the fabric has an L* value of 18.89, an a* value of 0.72 and a b* value of −5.92. This indicates that improved dye characteristics result with the use of the present carrier as compared to the use of CHP and Antiblaze ® 100 as the carrier system.

EXAMPLE 7

In order to demonstrate the effectiveness of the present carrier when an emulsifier and a flame retardant are included with the carrier, the steps of Example 1 are repeated except the carrier system used at 2.65 g/100 ml of dyebath includes 0.5 g/100 ml of dyebath of Phosphoteric T-C6 ® and 0.15 g/100 ml of dyebath of Antiblaze ® 100 flame retardant in a weight ratio of 4:1:0.3 DEET to emulsifier to flame retardant. The resulting fabric had a deep shade of blue, and a L* value of 17.01, an a* value of 0.25 and a b* value of −6.00.

EXAMPLE 8

In order to demonstrate the effectiveness of the present carrier when a different emulsifier is included with the carrier, Example 7 is repeated except Solv-It ® is used, and the navy blue cationic dye comprises 11.25% owf 100% Basacryl Blue X-3GL, 1.41% owf Basacryl Red GL and 0.90% owf 200% Basacryl Golden Yellow X-GFL. The resulting fabric had a deep shade of blue, and an L* value of 18.00, an a* value of 1.09 and a b* value of −6.68.

EXAMPLE 9

In order to demonstrate the effectiveness of the present carrier when a different emulsifier is included with the carrier, Example 7 is repeated except 0.5 g/100 ml of dyebath of Witcomul ® AM2-1OC is used instead of the Phosphoteric T-C6 ® , and the navy blue cationic dye comprises 11.25% owf 100% Basacryl Blue X-3GL, 1.41% owf Basacryl Red GL and 0.90% owf 200% Basacryl Golden Yellow X-GFL. The resulting fabric had a deep shade of blue, and an L* value of 17.45, an a* value of 0.40 and a b* value of −5.99.

The results of Examples 6–9 indicate that excellent depth of shade properties can be provided when emulsifier and/or a flame retardant are included with the carrier system.

The dyed fabrics of Examples 6 and 8 were also tested for flame resistance using Federal Test Method 191-5905 Flame Contact Test. Test Method 191-5905 is a measurement of the resistance of fabric and other textiles to flame propagation due to a flame source. An initial test specimen, 2 ¾ inches by 12 inches, (70 mm by 120 mm) is exposed to high temperature butane gas flame 3 inches (76 mm) in height by vertical suspension in the flame for 12 seconds, the lowest portion of the specimen always 1 ½ inches (38 mm) above the center of the burner. At the end of 12 seconds, the specimen is withdrawn from the flame slowly, and the after-flaming is timed. Then the specimen is re-introduced into the flame and again slowly withdrawn after 12 seconds and after-flame timed. Additionally, a second specimen is tested after five launderings at 140° F. under the conditions specified in AATCC Method 135-3II, B. The results are reported as percent consumed of the original specimen ("Original") and after five launderings ("after/5") wherein $$\text{Percent consumed} = \frac{L - A}{L} \times 100$$

where

L=Original length of specimen

A=Length of uncharred part of specimen from the top of the specimen down the side with less charred area to the point at which the uncharred area first reaches a width of less than 1 inch (25 mm).

The results are reported in Table 1 with a scoured-only Nomex® T-455 sample used as a standard.

TABLE 1

| Example No. | Ave % Consumed Warp | | Ave % Consumed Fill |
|---|---|---|---|
| Standard | Original | 19.9 | 17.3 |
| | After/5 | 14.9 | 13.8 |
| 6 | Original | 9.9 | 10.2 |
| | Ater/5 | 9.9 | 8.1 |
| 8 | Original | 9.2 | 8.9 |
| | After/5 | 13.5 | 11.8 |

The results indicate that super flame resistant properties (i.e., less than 25% consumed) can be provided by the use of a carrier with a flame retardant alone and/or a carrier with an emulsifier and a flame retardant. Moreover, the flame retardant properties obtained by use of the present carrier system, compared favorably to those of the standard, scoured only Nomex® T-455.

EXAMPLE 10

In order to demonstrate the effectiveness of the carrier with an emulsifier and a flame retardant at different weight ratios, the steps of Example 8 are repeated using only 2.0 g/100 ml of dyebath total carrier system except the weight ratio is 3:2:0.3 DEET to Solv-It® to flame retardant. The resulting fabric had a deep shade of blue, and an L* value of 18.06, an a* value of 0.14 and a b* value of −7.75.

EXAMPLE 11

In order to demonstrate further the effectiveness of the carrier with an emulsifier and a flame retardant at different weight ratios, the steps of Example 10 are repeated except the weight ratio is 2:3:0.3 DEET to Solv-It® to flame retardant. The resulting fabric had a deep shade of blue, and an L* value of 19.30, an a* value of 0.66 and a b* value of −10.56. This indicates that at ratio of less than 2:3:0.3, the improved dyeing characteristics obtained with this carrier system combination will begin to decrease, and thus the effectiveness of the carrier will decrease.

EXAMPLE 12

In order to demonstrate further the effectiveness of the present carrier, the steps of the Example 1 are repeated except the fiber used is 100% Kevlar®, the carrier is 4:1 DEET to Solv-It® at 2.0 g/100 ml of dyebath, and the navy blue cationic dye comprises 14.63% owf Basacryl Blue X-3GL, 0.93% owf Basacryl Red GL and 1.00% owf 200% Basacryl Golden Yellow X-GFL. The resulting fabric had an L* value of 20.12, an a* value of −1.57 and a b* value of −6.97.

EXAMPLE 13

In order to further demonstrate the effectiveness of the present carrier, the steps of the Example 1 are repeated except the fiber used is 100% Kevlar®, the carrier is 4:1:0.3 DEET to Solv-It® to Antiblaze® 100 flame retardant at 2.0 g/100 ml of dyebath and the navy blue cationic dye comprises 14.63% owf Basacryl Blue X-3GL, 0.93% owf Basacryl Red GL and 1.00% owf 200% Basacryl Golden Yellow X-GFL. The resulting fabric had an L* value of 19.06, an a* value of −1.39 and a b* value of −6.78.

Examples 12 and 13 illustrate that the carrier with an emulsifier or with an emulsifier and flame retardant can be used to dye Kevlar® effectively.

EXAMPLE 14

In order to further demonstrate the effectiveness of the present carrier, the steps of the Example 1 are repeated except the fiber used is 100% PBI, the carrier used at 2.0 g/100 ml of dyebath is 4:1 DEET to Solv-It® emulsifier and the trigger blue cationic dye comprises 6.00% owf 100% Basacryl Blue X-3GL, 1.00% owf Basacryl Red GL and 0.01% owf 200% Basacryl Golden Yellow X-GFL. The resulting fabric had an L* value of 23.95, an a* value to −3.47 and a b* value of 0.27.

EXAMPLE 15

In order to further demonstrate the effectiveness of the present carrier in dyeing 100% PBI, the steps of Example 14 are repeated except the carrier is 4:1 DEET to Phosphoteric T-C6®. The resulting fabric had an L* value of 21.32, an a* value of −2.78 and a b* value of −2.23.

Examples 14 and 15 illustrate that the carrier with an emulsifier can be used to effectively dye 100% PBI.

EXAMPLE 16

In order to further demonstrate the effectiveness of the present carrier with a blend of PBI and Nomex® fibers, the steps of Example 1 are repeated except the fiber used is a PBI/Nomex® T-455 20:80 blend, the carrier used at 2.0 g/100 ml of dyebath is 4:1 DEET to Solv-It® emulsifier, and the trigger blue cationic dye comprises 6.00% owf 100% Basacryl Blue X-3GL, 1.00% owf Basacryl Red GL and 0.01% owf 200% Basacryl Golden Yellow X-GFL. The resulting fabric had an L* value of 23.78, an a* value of 0.50 and a b* value of −16.31.

EXAMPLE 17

In order to further demonstrate the effectiveness of the present carrier with a blend of PBI and Nomex® fibers, the steps of Example 16 are repeated except the carrier used is 4:1 DEET to Phosphoteric T-C6®. The resulting fabric had an L* value of 23.63, an a* value of 0.74 and a b* value of −17.47.

Examples 16–17 indicate that a PBI/Nomex® blend can be dyed effectively with the carrier and the emulsifier.

EXAMPLE 18

In order to demonstrate further the effectiveness of the present carrier with a blend of PBI and Nomex® fibers and to demonstrate the criticality of the presence of the carrier, the steps of Example 16 are repeated except only 0.38 g/100 ml of dyebath of Solv-It® is used. The resulting fabric had an L* value of 28.59, and a* value of −0.99 and a b* value of −15.95.

EXAMPLE 19

In order to demonstrate further the effectiveness of the present carrier with a blend of PBI and Nomex® fibers and to demonstrate the criticality of the presence of the carrier, the steps of Example 16 are repeated except only 0.38 g/100 ml of dyebath of Phosphoteric T-C6® is used. The resulting fabric had an L* value of 28.93, an a* value of −0.90 and a b* value of −16.13.

EXAMPLE 20

In order to demonstrate further the effectiveness of the present carrier with a blend of PBI and Nomex® fibers and to demonstrate the criticality of the presence of the carrier, the steps of Example 16 are repeated except only 0.38 g/100 ml of dyebath of Witcomul® AM2-10C is used. The resulting fabric had an L* value of 29.30, an a* value of −0.88 and a b* value of −14.20.

Examples 18–20 and the high L* values demonstrate the need for the use of the present carrier inasmuch as the use of an emulsifier without the present carrier results in poor dyeing.

EXAMPLE 21

In order to demonstrate further the effectiveness of the present carrier including a flame retardant with a blend of PBI and Nomex® fibers, the steps of Example 16 are repeated except, the carrier is 4:1:0.3 DEET to Solv-It® to Antiblaze® 100 flame retardant. The resulting fabric had an L* value of 3.66, an a* value of 0.63 and a b* value of −16.31.

EXAMPLE 22

In order to demonstrate further the effectiveness of the present carrier including a flame retardant with a blend of PBI and Nomex® fibers, the steps of Example 16 are repeated except, the carrier is 4:1:0.3 DEET to Phosphoteric T-C6® to Antiblaze® 100 flame retardant. The resulting fabric had an L* value of 24.87, an a* value of 0.17 and a b* value of −17.19.

EXAMPLE 23

In order to demonstrate further the effectiveness of the present carrier including a flame retardant with a blend of PBI and Nomex® fibers, the steps of Example 16 are repeated except, the carrier is 4:1:0.3 DEET to Witcomul® AM2-1OC to Antiblaze® 100 flame retardant. The resulting fabric had an L* value of 21.43, an a* value of 1.24 and a b* value of −13.27.

Examples 21–23 indicate that a PBI/Nomex® blend can be dyed effectively with the carrier, an emulsifier and a flame retardant.

EXAMPLE 24

In order to demonstrate further the effectiveness of the present carrier with a blend of PBI and Kevlar® fibers, the steps of Example 1 are repeated except the fiber used is a PBI/Kevlar® 40:60 blend, the carrier used at 2.0 g/100 ml of dyebath is 4:1 DEET to Solv-It®, and the navy blue cationic dye comprises 69.00% owf 100% Basacryl Blue X-3GL and 15.00% owf Basacryl Red GL. The resulting fabric had an L* value of 23.44, an a* value of 1.68 and a b* value of −5.34 indicating that a PBI/Kevlar® blend can be dyed effectively with the carrier and an emulsifier.

EXAMPLE 25

In order to demonstrate further the effectiveness of the present carrier including a flame retardant with a blend of PBI and Kevlar® fibers, the steps of Example 1 are repeated except the fiber used is a PBI/Kevlar® 40:60 blend, the carrier used at 2.0 g/100 ml of dyebath is 4:1:0.3 DEET to Solv-It® to Antiblaze® 100 flame retardant, and the navy blue cationic dye comprises 69.00% owf 100% Basacryl Blue X-3GL and 15.00% owf Basacryl Red GL. The resulting fabric had an L* value of 24.03, an a* value of 1.68 and a b* value of −5.44 indicating that a PBI/Kevlar® blend can be dyed effectively with the carrier and an emulsifier and a flame retardant.

The results of Examples 24–25 indicate that blends of Kevlar® and PBI can be dyed effectively by the use of the carrier system of the present invention.

In the specification and examples, there have been disclosed preferred embodiments of the invention, although specific terms are employed, they are used in a generic and descriptive sense only and not for the purpose of limitation, the scope of the invention being defined by the following claims.

That which is claimed is:

1. A method for dyeing fibrous material comprising the steps of:

consisting of aromatic polyamide fibers, polybenzimidazole fibers, aromatic polyimide fibers, fibers of copolymers of the monomers thereof, or blends thereof with an aqueous dyebath comprising a mixture of a carrier and a dye soluble or dispersed in the dyebath, the carrier comprising N,N-diethyl (m-toluamide); and heating the fiber while in contact with the dyebath to fix said dye within the fibrous material.

2. A method according to claim 1 wherein the mixture includes an emulsifier.

3. A method according to claim 2 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

4. A method according to claim 1 or 2 wherein the mixture includes a flame retardant.

5. A method according to claim 1 wherein the aromatic polyamide is poly(m-phenyleneisophthalamide), poly(p-phenyleneterephthalamide), copolymers of the monomers thereof, or blends thereof.

6. A method according to claim 1 wherein the fiber comprises a blend of aromatic polyamide and polybenzimidazole fibers.

7. A method according to claim 1 or 2 wherein said step of contacting the fibrous material with the mixture of the carrier and the dye is conducted at a temperature of from about 100° F. to about 300° F. and at from about 1 to about 4 atm pressure.

8. A method according to claim 7 wherein said step of contacting the fibrous material with the mixture of the carrier and the dye is conducted at a temperature of above about 250° F. and at a pressure above about 2.5 atm, and held at the temperature and pressure for about 30 minutes to about 1.5 hours.

9. A fabric formed from the fibrous material dyed by the method of claim 1 or 2.

10. A method for dyeing fibrous material particularly adapted for use in reducing the adverse affect of dyeing methods on the fame resistant properties of fibrous material having inherent flame resistant properties, the method comprising the steps of:

contacting aromatic polyamide fibers, polybenzimideazole fibers, aromatic polyimide fibers, fibers of copolymers of the monomers thereof, or blends thereof with an aqueous dyebath comprising a mixture of a carrier and a dye soluble or dispersed within the dyebath, the carrier comprising N,N-diethyl (m-toluamide), an emulsifier and a flame retardant; and heating the fiber while in contact with the dyebath to fix said dye and flame retardant within the fibers.

11. A method according to claim 10 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 7 5 moles of propylene oxide and 20 to 75 moles of ethylene oxide.

12. A method according to claim 10 wherein said step of contacting the fibers with the mixture of the carrier and the dye is conducted at a temperature of from about 100° F. to about 300° F. and at from about 1 to about 4 atm pressure.

13. A method according to claim 10 wherein said step of contacting the fibers with the mixture of the carrier and the dye is conducted at a temperature of above about 250° F. and at a pressure above about 2.5 atm, and held at the temperature and pressure for about 30 minutes to about 1.5 hours.

14. A fabric in which the fibers are dyed by the method of claim 10.

15. In a method for treating fibers with an additive which includes the step of contacting fibrous material selected from the group consisting of aromatic polyamide fibers, polybenzimidazole fibers, aromatic polyimide fibers, fibers of copolymers of the monomers thereof, or blends thereof with an aqueous dyebath comprising a mixture of a carrier and an additive selected from the group consisting of soluble or dispersed with the carrier, the improvement comprising the use, as the carrier, of N,N-diethyl(m-toluamide).

16. In a method according to claim 15 wherein the mixture includes an emulsifier.

17. In a method according to claim 16 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

18. In a method according to claim 15 or 16 wherein the mixture includes a flame retardant.

19. In a method according to claim 15 or 16 wherein the fibrous material is contacted with the mixture of the carrier and the additive at a temperature of from about 100° F. to about 300° F. and at from about 1 to about 4 atm pressure.

20. In a method according to claim 19 wherein the fibrous material is contacted with the mixture of the carrier and the additive at a temperature of above about 250° F. and at a pressure above about 2.5 atm, and held at the temperature and pressure for about 30 minutes to about 1.5 hours.

21. In a method for dyeing aromatic polyamide fibers, polybenzimidazole fibers, aromatic polyimide fibers, fibers of copolymers of the monomers thereof, or blends thereof in an aqueous dyebath which includes the step of contacting the fibers with a mixture of a carrier and a dye soluble or dispersed in the dyebath, the improvement comprising the use, as the carrier, of an N,N-diethyl (m-toluamide), an emulsifier and a flame retardant.

22. In a method according to claim 21 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

23. In a method according to claim 21 wherein the fibrous material is contacted with the mixture of the carrier and the additive at a temperature of from about 100° F. to about 300° F. and at from about 1 to about 4 atm pressure.

24. In a method according to claim 23 wherein the fibrous material is contacted with the mixture of the carrier and the additive at a temperature of above about 250° F. and at a pressure above about 2.5 atm, and held at the temperature and pressure for about 30 minutes to about 1.5 hours.

25. A fibrous material selected from the group consisting of aromatic polyamide fibers, polybenzimidazole fibers, aromatic polyimide fibers, fibers of copolymers of the monomers thereof, or blends thereof which has been dyed with a dyebath comprising a mixture of a carrier and a dye soluble or dispersed with the carrier ,the carrier comprising N,N-diethyl (m-toluamide).

26. A fibrous material according to claim 25 wherein the mixture includes an emulsifier.

27. A fibrous material according to claim 26 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

28. A fibrous material according to claim 25 or 26 wherein the mixture includes a flame retardant.

29. A fabric formed from the fibrous material of claim 25 or 26.

30. A fiber of aromatic polyamides, polybenzimidazoles, aromatic polyimides, copolymers of the monomers thereof or blends thereof dyed with an aqueous mixture of a carrier and a dye soluble or dispersed in the dyebath, the carrier comprisins N,N-diethyl (m-toluamide), an emulsifier, and a flame retardant.

31. A fiber according to claim 30 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

32. A fiber according to claim 30 wherein the aromatic polyamide is poly(m-phenyleneisophthalamide), poly(p-phenyleneterephthalamide), copolymers of the monomers thereof, or blends thereof.

33. A fiber according to claim 30 wherein the fiber comprises a blend of aromatic polyamide and polybenzimidazole fibers.

34. A fabric formed from the fibers of claim 30.

35. A method for dyeing fibrous material comprising the steps of:

contacting a fibrous material selected from the group consisting of aromatic polyamide fibers, polybenzimidazole fibers, aromatic polyimide fibers, fibers of copolymers of the monomers thereof, or blends thereof with an aqueous dyebath comprising a mixture of a carrie and a cationic dye soluble or dispersed in the dyebath, the carrier comprising N,N-diethyl (m-toluamide) or mixture thereof; and heating the fiber while in contact with the dyebath to fix said dye within the fibrous material.

36. A method according to claim 35 wherein the carrier includes an emulsifier.

37. A method according to claim 35 wherein the emulsifier is a blend of the free acid form of a phosphated ethoxylated dialkyl phenol containing from about 2 to 20 moles of ethylene oxide and a non-ionic propoxylated-ethoxylated alcohol containing from about 20 to 75 moles of propylene oxide and 20 to 75 moles of ethylene oxide.

38. A method according to claim 35 or 36 wherein the carrier includes a flame retardant.

39. A method according to claim 35 wherein the fiber comprises a blend of aromatic polyamide and polybenzimidazole fibers.

* * * * *

UNITED STATES PATENT AND TRADEMARK OFFICE

CERTIFICATE OF CORRECTION

PATENT NO. : 5,207,803

DATED : May 4, 1993

INVENTOR(S) : John R. Holsten

It is certified that error appears in the above-identified patent and that said Letters Patent is hereby corrected as shown below:

Column 3, line 68, "methylnaphthalene", should read --methyl-napthtalene,--

Column 4, line 10, "Richmond, Va.", should read --Richmond, Va. having the formula,--

Column 4, line 24, "phosphates", should read --phosphates, having the exemplary formula,--

Column 6, line 36, "illustrative", should read --illustrative examples.--

Column 11, line 37, "3.66", should read --23.66--.

Column 12, line 29, after "steps of", should read --contacting a fibrous material selected from the group--.

Column 13, line 23, "7 5", should read --75--.

Signed and Sealed this

Second Day of November, 1993

Attest:

Bruce Lehman

BRUCE LEHMAN

Attesting Officer

Commissioner of Patents and Trademarks